US007770998B2

(12) United States Patent
Shinohara et al.

(10) Patent No.: US 7,770,998 B2
(45) Date of Patent: Aug. 10, 2010

(54) METHOD AND APPARATUS FOR COLOR IMAGE FORMING CAPABLE OF EFFECTIVELY FORMING A QUALITY COLOR IMAGE

(75) Inventors: Tadashi Shinohara, Kanagawa-ken (JP); Shinji Kobayashi, Tokyo (JP); Takao Watanabe, Kanagawa-ken (JP); Nobuyoshi Kaima, Tokyo (JP); Yuichiro Shukuya, Tokyo (JP); Yoshiaki Kawai, Kanagawa-ken (JP); Kazuyuki Sato, Kanagawa-ken (JP)

(73) Assignee: Ricoh Co., Ltd., Tokyo (JP)

( * ) Notice: Subject to any disclaimer, the term of this patent is extended or adjusted under 35 U.S.C. 154(b) by 296 days.

(21) Appl. No.: 11/565,422

(22) Filed: Nov. 30, 2006

(65) Prior Publication Data

US 2007/0140721 A1 Jun. 21, 2007

(30) Foreign Application Priority Data

Nov. 30, 2005 (JP) ..... 2005-346298

(51) Int. Cl.
*B41J 29/393* (2006.01)

(52) U.S. Cl. ..... 347/19; 347/5; 347/15

(58) Field of Classification Search ..... 399/49, 399/26; 347/5, 9, 12, 15, 19
See application file for complete search history.

(56) References Cited

U.S. PATENT DOCUMENTS 5,737,665 A 4/1998 Sugiyama et al.
5,765,083 A 6/1998 Shinohara
5,903,796 A * 5/1999 Budnik et al. ..... 399/26
6,118,557 A 9/2000 Sugiyama et al.
6,128,459 A 10/2000 Iwata et al.
6,282,396 B1 8/2001 Iwata et al.
6,295,435 B1 9/2001 Shinohara et al.
6,380,960 B1 4/2002 Shinohara
6,381,435 B2 4/2002 Shinohara et al.
6,573,918 B2 6/2003 Kobayashi et al.
6,684,035 B2 * 1/2004 Furno et al. ..... 399/49
6,693,654 B2 2/2004 Shinohara
6,704,035 B2 3/2004 Kobayashi et al.
6,711,364 B2 3/2004 Shinohara
6,804,479 B2 * 10/2004 Kimura ..... 399/49
6,949,896 B2 9/2005 Andoh et al.
2003/0137577 A1 7/2003 Shinohara
2004/0041896 A1 3/2004 Shinohara
2005/0052488 A1 * 3/2005 Inoue ..... 347/19
2005/0200689 A1 9/2005 Shinohara et al.

FOREIGN PATENT DOCUMENTS

JP 2005-091901 4/2005

* cited by examiner

*Primary Examiner*—Lam S Nguyen
(74) *Attorney, Agent, or Firm*—Oblon, Spivak, McClelland, Maier & Neustadt, L.L.P.

(57) ABSTRACT

A maintenance pattern forming method includes conveying, generating, and forming. The conveying conveys a transfer member on a surface of a conveying member such that there is a spacing area between two adjacent transfer members on the surface of the conveying member. The generating generates a timing signal for at least one of a plurality of colors formed by a color image forming apparatus. The forming forms at least one of a process control pattern, a position adjustment pattern, and a blade curl suppression pattern onto the spacing area based on the timing signal.

9 Claims, 5 Drawing Sheets

METHOD AND APPARATUS FOR COLOR IMAGE FORMING CAPABLE OF EFFECTIVELY FORMING A QUALITY COLOR IMAGE

CROSS REFERENCE TO RELATED APPLICATIONS

This patent specification is based on Japanese patent application, No. JP2005-346298 filed on Nov. 30, 2005 in the Japan Patent Office, the entire contents of which are incorporated by reference herein.

BACKGROUND OF THE INVENTION

1. Field of the Invention

The present invention relates to a method and apparatus for color image forming, and more particularly to a method and apparatus for color image forming capable of effectively forming a quality color image by simplifying maintenance pattern management.

2. Discussion of the Background

As a background, the color image forming apparatus described in Japanese Patent Application Laid-Open No. 2005-91901 is known. The color image forming apparatus described in Japanese Patent Application Laid-Open No. 2005-91901 (hereinafter "background image forming apparatus") forms density detection patterns on a non-image-formation area of a conveyor belt during continuous printing. The background color image forming apparatus then changes image forming conditions of position detection patterns based on detection results of the density detection patterns. Thus, a positional displacement, which may be caused when toner images of different colors are superposed upon each other, can be suitably corrected while image formation efficiency is increased.

More specifically, in the background color image forming apparatus, the position detection patterns are formed on the conveyor belt with image forming mechanisms of respective colors, and are detected with an image position detector. Then, based on results detected with the image position detector, displacement correction processing is executed to correct the positional displacement.

For the displacement correction processing, density detection patterns are formed on a non-image-formation area of the conveyor belt while image formation is not performed onto a transfer sheet. Then, the density detection patterns are detected with the image position detector. Based on results detected with the image position detector, image forming conditions are determined to form the position detection patterns with the image forming mechanisms during execution of the displacement correction processing.

In the background color image forming apparatus according to the above patent document, a system controller starts positional displacement correction when it receives a permission notification for starting the positional displacement correction from a position adjustment controller. The system controller initially detects a density detection pattern formed on a non-image-formation area of the conveyor belt. The density detection pattern is detected with a reflected light sensor of the image position detector.

However, the above patent document does not describe details relating to a position and a timing at which the density detection pattern is formed. In fact, particular consideration is not paid to the position and timing at which the non-image-area density detection pattern is formed.

SUMMARY OF THE INVENTION

This patent specification describes a maintenance pattern forming method which can effectively form a quality color image by simplifying maintenance pattern management. In one example, a maintenance pattern forming method includes the steps of conveying, generating, and forming. The conveying step conveys a transfer member on a surface of a conveying member such that there is a spacing area between two adjacent transfer members. The generating step generates a timing signal for at least one of a plurality of colors formed by the color image forming apparatus. The forming step forms at least one pattern onto the spacing area based on the timing signal. The pattern can be, but is not limited to, at least one of a process control pattern, a position adjustment pattern, or a blade curl suppression pattern.

This patent specification further describes a novel color image forming apparatus which can effectively form a quality color image by simplifying maintenance pattern management. In one embodiment, a color image forming apparatus includes a conveying member, a plurality of image carrying members, a signal generator, and a pattern formation mechanism. The conveying member has a surface to convey a transfer member, the surface including a spacing area between two adjacent transfer members. The plurality of image carrying members are arranged in tandem and carry images. The images are transferred onto the transfer member conveyed by the conveying member. The signal generator generates a timing signal for at least one of a plurality of colors formed by the color image forming apparatus. The pattern formation mechanism forms a pattern on the spacing area based on the timing signal. The pattern can be, but is not limited to, at least one of a process control pattern, a position adjustment pattern, or a blade curl suppression pattern.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
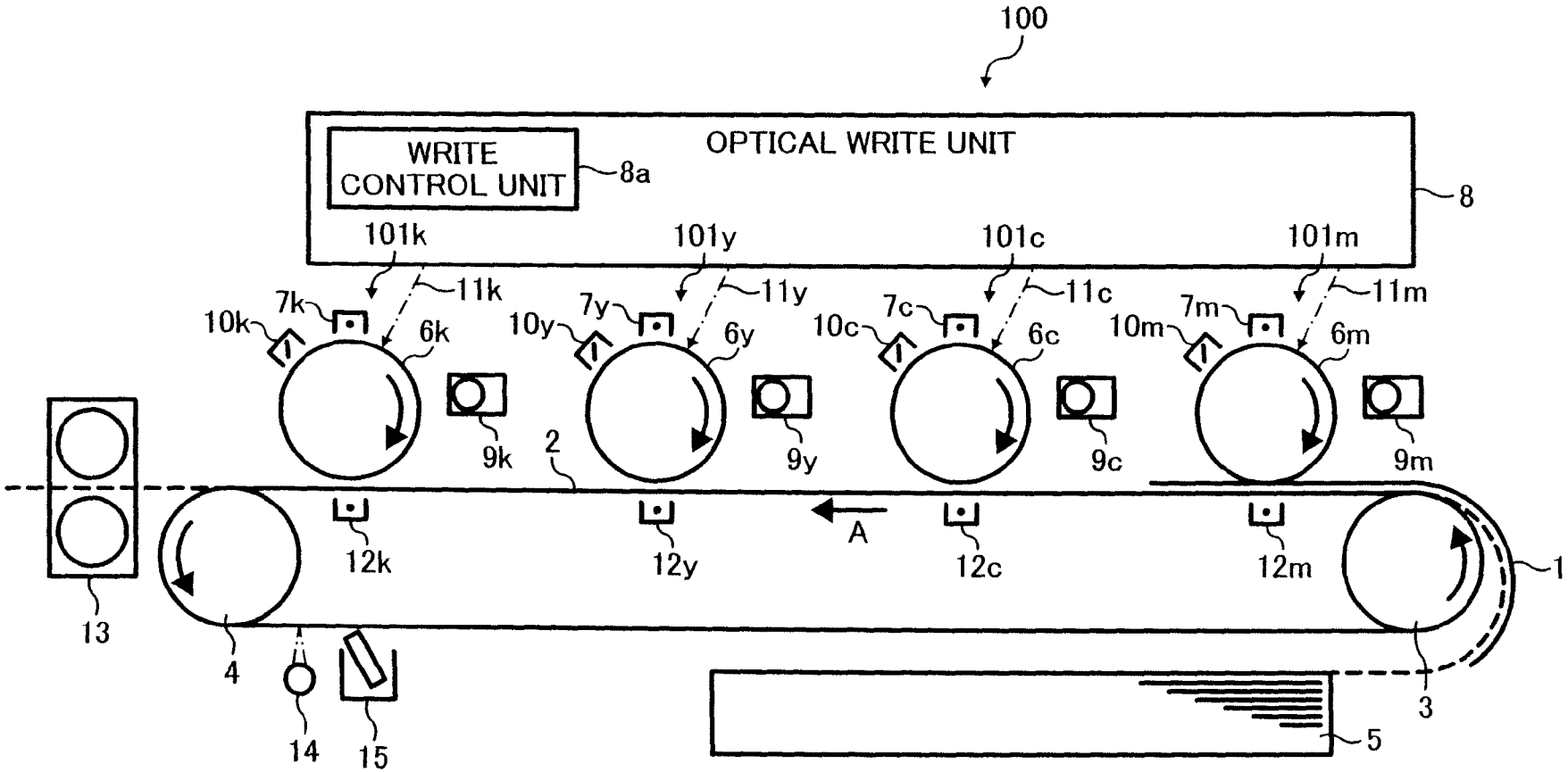
FIG. 1 is a diagram illustrating a schematic configuration of a color image forming apparatus according to one embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIG. 1, an image forming apparatus 100 according to an exemplary embodiment of the present invention is described.

As illustrated in FIG. 1, the image forming apparatus 100 includes a conveyor belt 2, a drive roller 3, a driven roller 4, a sheet feed tray 5, an optical write unit 8, a fuser 13, a detection sensor 14, and a cleaner 15. The image forming apparatus 100 also includes an image forming mechanism 101*m*, an image forming mechanism 101*c*, an image forming mechanism 101*y*, and an image forming mechanism 101*k*.

The image forming mechanism 101*m* has a photosensitive drum 6*m*, a charger 7*m*, a developer 9*m*, a photosensitive drum cleaner 10*m*, and a transfer unit 12*m*. The other image forming mechanisms 101*c*, 101*y*, and 101*k* have a similar configuration to the image forming mechanism 101*m*.

The conveyor belt 2 is stretched between the drive roller 3 that is rotationally driven and the driven roller 4 that is dependently driven thereby. The conveyor belt 2 is rotated by rotation of the drive roller 3 to convey a transfer sheet 1. The sheet feed tray 5 for storing the transfer sheet 1 is provided below the conveyor belt 2.

The image forming mechanisms 101*m*, 101*c*, 101*y*, and 101*k* are arranged in tandem along the conveyor belt 2. The image forming mechanisms 101*m*, 101*c*, 101*y*, and 101*k* form images in magenta (m), cyan (c), yellow (y), and black (k) colors, respectively. Although the image forming mechanisms 101*m*, 101*c*, 101*y*, and 101*k* are arranged in the order in FIG. 1, the arrangement of the present invention is not limited to the order, and other arbitrary orders may be applicable.

The optical write unit 8 is provided above the image forming mechanisms 101*m*, 101*c*, 101*y*, and 101*k*. The optical write unit 8 exposes surfaces of the photosensitive drums 6*m*, 6*c*, 6*y*, and 6*k* with laser beams 11*m*, 11*c*, 11*y*, and 11*k*, respectively, according to the image color. The optical write unit 8 also includes a write control unit 8*a* described later.

In the image forming mechanism 101*m*, the photosensitive drum 6*m* is arranged at a position surrounding by the charger 7*m*, the developer 9*m*, the transfer unit 12*m*, and the photosensitive drum cleaner 10*m*. The photosensitive drum 6*m* serves as a photosensitive member on which an electrostatic latent image is formed.

The charger 7*m* uniformly charges the surface of the photosensitive drum 6*m*. The optical write unit 8 forms an electrostatic latent image with the laser beam 11*m* on the surface of the photosensitive drum 6*m*.

The developer 9*m* develops the electrostatic latent image with magenta color toner to form a magenta toner image on the surface of the photosensitive drum 6*m*. The transfer unit 12*m* transfers the magenta toner image to the transfer sheet 1. The photosensitive drum cleaner 10*m* removes excess toner remaining on the surface of the photosensitive drum 6*m*.

The units in the other image forming mechanisms 101*c*, 101*y*, and 101*k* have a similar arrangement to the units in the image forming mechanism 101*m*. Furthermore, the units in the other image forming mechanisms 101*c*, 101*y*, and 101*k* operate in a similar manner to the units in the image forming mechanism 101*m* to superimposingly form toner images of cyan, yellow, and black, respectively, onto the magenta toner image of the transfer sheet 1.

The fuser 13 is arranged at a position spaced from the conveyor belt 2 on a downstream side in a conveyance direction of the transfer sheet 1. After the transfer sheet 1 is separated from the conveyor belt 2, the fuser 13 fixes the toner images on the transfer sheet 1.

The detection sensor 14 is arranged at a position opposed to the conveyor belt 2, and detects a position adjustment pattern and a process control pattern on the conveyor belt 2.

The cleaner 15 is also arranged at a position opposed to the conveyor belt 2, and removes the position adjustment pattern and the process control pattern detected with the detection sensor 14.

Upon the start of image formation, one transfer sheet 1 at the top of the transfer sheets 1 stored in the sheet feed tray 5 is fed to the conveyor belt 2, which is being rotated in a direction indicated by an arrow A in FIG. 1. Then, the transfer sheet 1 is electrostatically attracted to the conveyor belt 2, and is conveyed to the image forming mechanism 101*m*.

In the image forming mechanism 101*m*, the surface of the photosensitive drum 6*m* is uniformly charged with the charger 7*m*. Then, the optical write unit 8 emits the laser beam 11*m* to form an electrostatic latent image on the surface of the photosensitive drum 6*m*.

The developer 9*m* develops the resultant electrostatic latent image with magenta toner to form a magenta toner image on the photosensitive drum 6*m*. When the transfer sheet 1 is conveyed to a transfer position at which the transfer sheet 1 on the conveyor belt 2 contacts the photosensitive drum 6*m*, the transfer unit 12*m* transfers the magenta toner image onto the transfer sheet 1.

Thus, the image of a single magenta color is formed on the transfer sheet 1. Then, the photosensitive drum cleaner 10*m* removes excess toner remaining on the surface of the photosensitive drum 6*m*. Thereby, the photosensitive drum 6*m* becomes ready for a following image formation.

Subsequently, the transfer sheet 1 that has been subjected to the transfer of the magenta toner image is conveyed to the image forming mechanism 101*c* with the conveyor belt 2.

Similar to the image forming mechanism 101*m*, the image forming mechanism 101*c* forms a cyan toner image on the surface of the photosensitive drum 6*c*. The transfer unit 12*c* superimposingly transfers the cyan toner image onto the transfer sheet 1.

The transfer sheet 1 is then conveyed to the image forming mechanism 101*y*, and subsequently the image forming mechanism 101*k*.

Similar to the image forming mechanisms 101*m* and 101*c*, the image forming mechanism 101*y* and the image forming mechanism 101*k* form a yellow toner image and a black toner image on the photosensitive drums 6*y* and 6*k*, respectively. Then, the transfer units 12*y* and 12*k* superimposingly transfer the yellow toner image and the black toner image, respectively, onto the transfer sheet 1 that has been subjected to the transfer of the magenta toner image.

After passing through the image forming mechanism 101*k*, the transfer sheet 1, which has a full-color toner image, is separated from the conveyor belt 2, and is moved to the fuser 13. The fuser 13 fixes the full-color toner image on the transfer sheet 1, and then the transfer sheet 1 is ejected.

Incidentally, the tandem-type image forming method as described above is generally called a direct transfer method, in which a toner image is directly transferred to a transfer sheet. In addition, an indirect transfer method may be used for the tandem-type image forming apparatus. In the indirect transfer method, a full-color image to be transferred is temporarily formed on an intermediate transfer belt, and then the resultant full-color image is transferred to a transfer sheet.

After the ejection of the transfer sheet 1, the detection sensor 14 arranged at a position opposed to the conveyor belt 2 detects a position adjustment pattern and a process control pattern. If the position adjustment pattern or the process control pattern is found, the cleaner 15 removes the position adjustment pattern or the process control pattern after completion of the detection.

Figure 2:
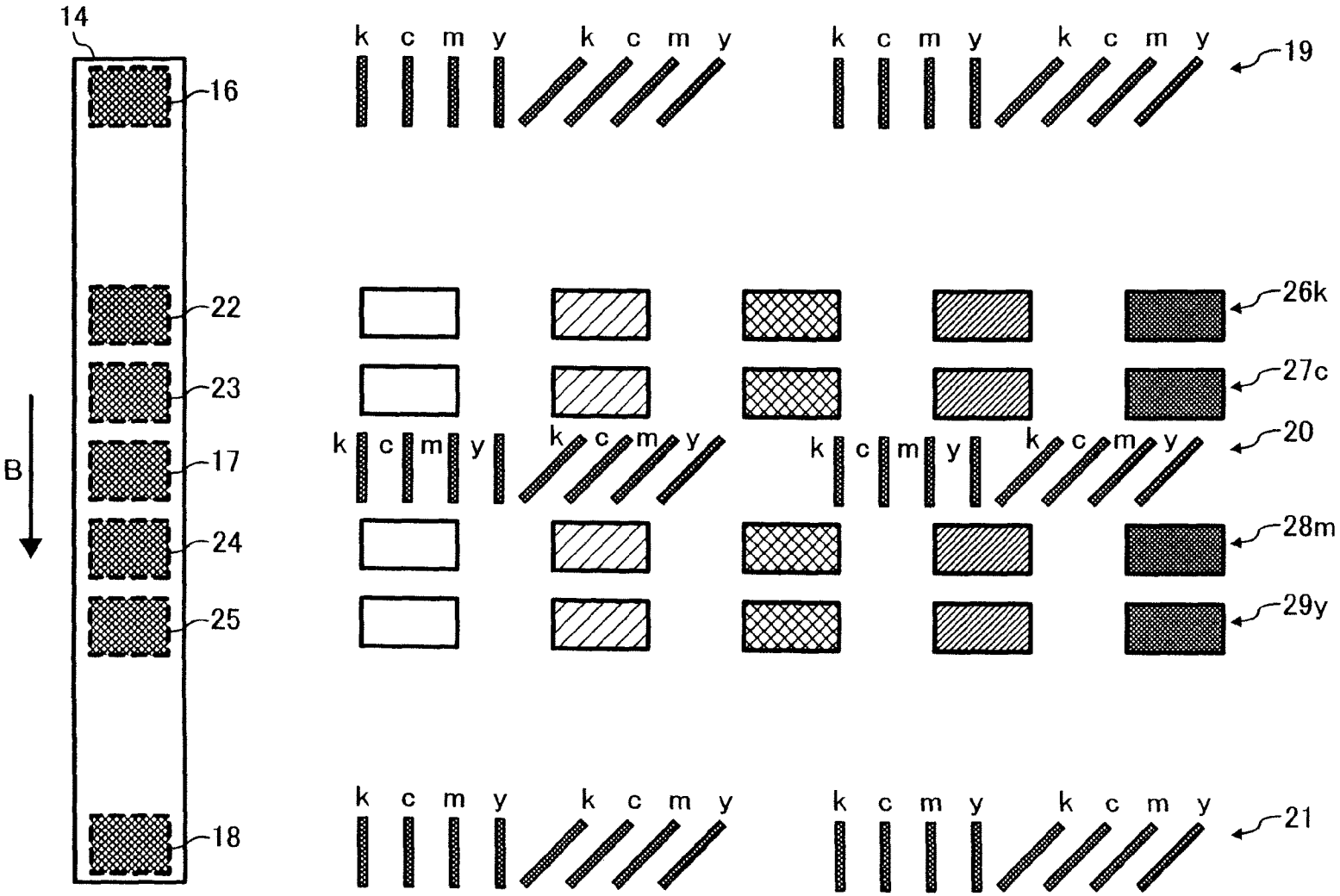
FIG. 2 is an explanatory diagram illustrating a configuration to detect, with a detection sensor unit, process control patterns and position adjustment patterns of respective colors formed on a conveyor belt.

Next, referring to FIG. 2, a configuration to detect the position adjustment pattern and the process control pattern with the detection sensor 14 of the present embodiment is described.

As illustrated in FIG. 2, the detection sensor 14 includes position adjustment pattern sensors 16, 17, and 18, and process control pattern sensors 22, 23, 24, and 25.

The position adjustment pattern sensors 16, 17, and 18 are arranged at a scanning start position, a central position, and a scanning end position, respectively, in a main scanning direction, which is a direction indicated by an arrow B in FIG. 2. The position adjustment pattern sensors 16, 17, and 18 detect position adjustment patterns 19, 20, and 21, respectively.

The position adjustment patterns 19, 20, and 21 are formed for each color at three positions on the conveyor belt 2 corresponding to the positions at which the position adjustment pattern sensors 16, 17, and 18 are arranged. Each of the position adjustment patterns 19, 20, and 21 is formed of a combination of black (k), cyan (c), magenta (m), and yellow (y) patterns being parallel to the main scanning direction and black, cyan, magenta, and yellow patterns being inclined at an approximately 45 degree angle to the main scanning direction.

The process control pattern sensors 22, 23, 24, and 25 are provided in the detection sensor 14, separately from the position adjustment pattern sensors 16, 17, and 18. The process control pattern sensors 22, 23, 24, and 25 detect process control patterns 26*k*, 27*c*, 28*m*, and 29*y* of black, cyan, magenta, and yellow colors, respectively.

Accordingly, the process control patterns 26*k*, 27*c*, 28*m*, and 29*y* are formed at positions in parallel with the process control pattern sensors 22, 23, 24, and 25, respectively.

For position adjustment control, skew from a standard color (e.g. black in the present embodiment), registration displacement in a sub-scanning direction, registration displacement in the main scanning direction, and magnification error in the main scanning direction can be measured.

For example, when a positional displacement due to magnification error is detected with the position adjustment pattern sensors 16, 17, and 18, an image formation process is controlled so that a following image is shifted by half of a maximum amount of the detected displacement in a direction opposite to a direction of the displacement. Thereby, the displacement amount can be corrected to a negligible level.

Furthermore, since three points in the main scanning direction are measured in the detection, a scanning line distortion can also be detected. Therefore, the registration displacement in the sub-scanning direction can optimally be corrected.

CPU 45, which will be described in greater detail later, can perform position adjustment control by calculating various displacement amounts and correction amounts and instructing to execute corrections.

On the other hand, for process control of image formation, a predetermined calculation is executed based on detection results with the position adjustment pattern sensors 16, 17, and 18, and the process control pattern sensors 22, 23, 24, and 25. Then, a condition of the image forming process, such as charging, development, and transfer, is changed according to the calculation result.

The positional displacement correction and the process control as described above may be executed with an instruction from an operation menu or a utility menu of the image forming apparatus 100, or a menu of a printer driver thereof. Alternatively, the positional displacement correction and the process control may be automatically executed according to a predetermined execution condition, such as an amount of time elapsed with the power of the image forming apparatus 100 turned on, an accumulated number of printed sheets, or a temperature increase amount of a portion (not illustrated) in the image forming apparatus 100.

Figure 3:
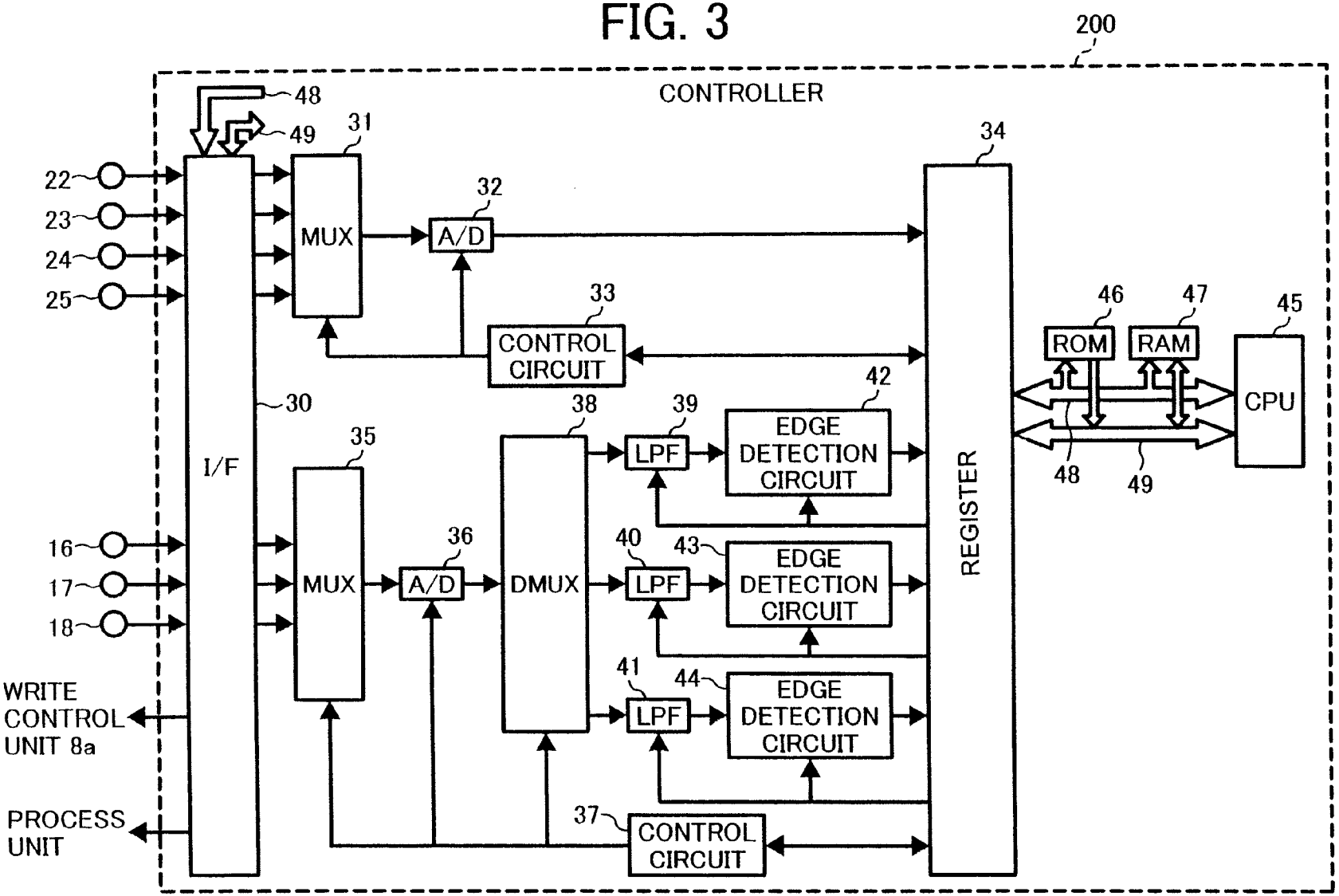
FIG. 3 is a block diagram illustrating a configuration of a control circuit to perform position adjustment processing and process control processing.

Next, referring to FIG. 3, a configuration of a controller 200 to perform processing of the position adjustment and the process control is described.

The controller 200 includes an input-output interface (I/F) 30, a multiplexer (MUX) 31, a multiplexer (MUX) 35, an analog-to-digital converter (A/D) 32, an analog-to-digital converter (A/D) 36, a control circuit 33, a control circuit 37, a demultiplexer (DMUX) 38, a low pass filter circuit (LPF) 39, a low pass filter circuit (LPF) 40, a low pass filter circuit (LPF) 41, an edge detection circuit 42, an edge detection circuit 43, an edge detection circuit 44, a register 34, a CPU (central processing unit) 45, a ROM (read only memory) 46, and a PAM (random access memory) 47.

Below, a control configuration of the controller 200 together with input and output of signal is described.

For processing of the process control, voltage signals detected with the process control pattern sensors 22, 23, 24, and 25 are input via the input-output interface 30 to the multiplexer 31.

The multiplexer 31 selects a sensor channel for the voltage signals, and outputs the voltage signal of the selected sensor channel to the analog-to-digital converter circuit 32. The analog-to-digital converter circuit 32 performs analog-to-digital conversion on the voltage signal of the selected sensor channel.

At this time, the control circuit 33 controls the multiplexer 31 to perform the sensor channel selection only during pattern formation. The control circuit 33 also controls the analog-to-digital converter circuit 32 to perform the analog-to-digital conversion only during pattern formation.

Then, the voltage signal digitally converted in the analog-to-digital converter circuit 32 is output to the register 34, and is stored therein. Based on the digitally converted voltage signal, the CPU 45 performs a calculation and changes a setting to change a condition of the image forming process, such as charging, development, and transfer. At this time, the CPU 45 executes the process control in accordance with a control program stored in the ROM 46, while using the RAM 47 as a work area.

On the other hand, for the position adjustment processing, voltage signals detected with the position adjustment pattern sensors 16, 17, and 18 are input via the input-output interface 30 to the multiplexer 35.

The multiplexer 35 selects a sensor channel for the voltage signals, and outputs the voltage signal of the selected sensor channel to the analog-to-digital converter circuit 36. The analog-to-digital converter circuit 36 performs analog-to-digital conversion on the voltage signal of the selected sensor channel.

At this time, the control circuit 37 controls the multiplexer 35 to perform the sensor channel selection only during pattern formation. The control circuit 37 also controls the analog-to-digital converter circuit 36 to perform the analog-to-digital conversion only during pattern formation.

Then, the voltage signal digitally converted in the analog-to-digital converter circuit 36 is output to the demultiplexer 38. The demultiplexer 38 selects one output destination of the digitally converted voltage signal from among the low pass filter circuits 39, 40, and 41, which are prepared for respective channels of the position adjustment pattern sensors 16, 17, and 18. The selected one of the low pass filter circuits 39, 40, and 41 receives the voltage signal, and cuts off a high frequency component thereof, thereby facilitating accurate recognition of pattern position in a following stage.

In the following stage, the edge detection circuits 42, 43, and 44 are provided for comparing a waveform of the voltage signal with a predetermined threshold voltage. The edge detection circuits 42, 43, and 44 extract a rise point and a fall point of the waveform, recognize a midpoint between the two points as a central position of the pattern, and store such data into the register 34.

Then, based on the data stored in the register 34, the CPU 45 performs a calculation and changes a setting to change a process condition and execute the position adjustment. The CPU 45 also performs such calculation and setting control in accordance with the control program stored in the ROM 46, while storing calculation data and setting data into the RAM 47.

The CPU 45 executes the above setting to change the process condition and the position adjustment in the write control unit 8*a* and a process unit via the input-output interface 30. Incidentally, the input-output interface 30, the ROM 46, and the RAM 47 are connected to one another via the address bus 48 and the data bus 49.

The write control unit 8*a* controls the exposure process of the optical write unit 8 based on the setting executed by the CPU 45. The process unit, which includes the image forming mechanisms 101*m*, 101*c*, 101*y*, and 101*k*, also performs image formation based on the setting executed by the CPU 45.

Furthermore, through changing setting values in the register 34, the CPU 45 performs start and stop of sampling, and switching of the sensor channels used for the analog-to-digital conversion, via the control circuit 33 and the control circuit 37. The CPU 45 also performs change of the frequencies to be cut off in the low pass filter circuits 39, 40, and 41, and setting of each threshold voltage in the edge detection circuit 42, 43, and 44.

Moreover, another aspect of signal processing for the position adjustment control executed in the controller 200 illustrated in FIG. 3 includes the low pass filter circuits 39, 40, and 41 performing product-sum calculations to select the sensor channel. In addition, the edge detection circuits 42, 43, and 44 execute calculations to compare a waveform of the voltage signal, which has been obtained after the analog-to-digital conversion and the cut-off, with a predetermined threshold voltage. The edge detection circuits recognize a point of the waveform at which the voltage signal first falls below the threshold voltage as a fall point (i.e. an edge portion) of the pattern, recognize a point of the waveform at which the voltage signal first rises above the threshold voltage as a rise point (i.e. another edge portion) of the pattern, and recognize a midpoint between the rise point and the fall point as a central position of the pattern.

Figure 4:
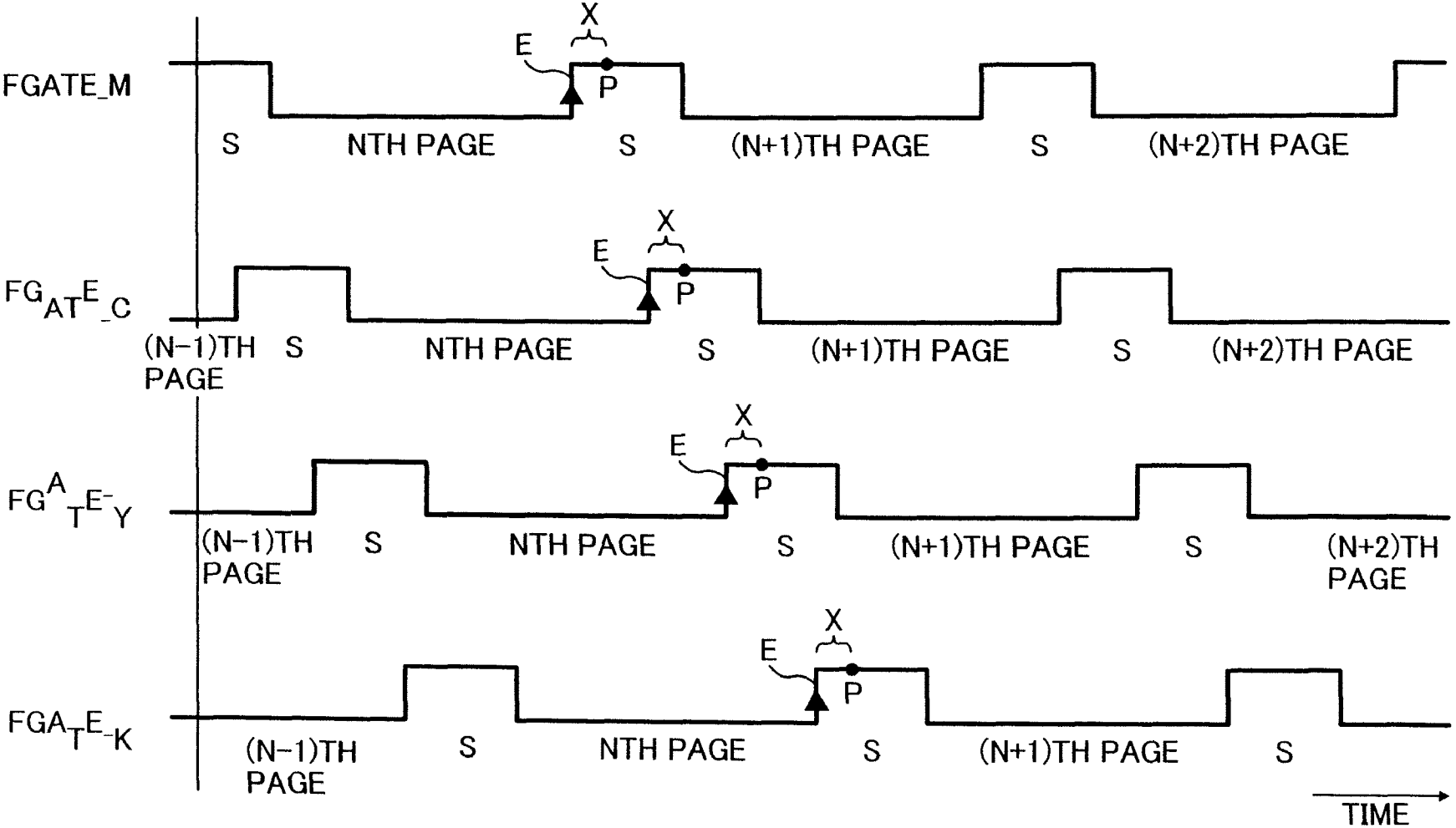
FIG. 4 is a timing chart illustrating timing of image formation in a sub-scanning direction in the color image forming apparatus of FIG. 1.

Next, referring to FIG. 4, a pattern forming method of the present embodiment is described. In the pattern forming method, a negation edge E of an image area signal in a sub-scanning direction, also referred to as a "sub-scan image area signal," is used as a reference point of pattern formation.

FIG. 4 is a timing chart illustrating a timing of image formation in the sub-scanning direction according to the present embodiment. More specifically, FIG. 4 illustrates a timing of image formation in continuous printing, during which respective images of magenta, cyan, yellow, and black colors are continuously formed on a plurality of the transfer sheets 1.

In FIG. 4, N−1, N, N+1, and N+2 represent page numbers of the transfer sheets 1 subjected to the image formation. Furthermore, S represents a spacing area between two adjacent transfer sheets conveyed on the conveyor belt 2 and across the width of the conveyor belt 2.

FGATE_M, FGATE_C, FGATE_Y, and FGATE_K represent sub-scan image area signals of magenta, cyan, yellow, and black, respectively, which are generated by the write control unit 8*a* of FIG. 1. FGATE_M, FGATE_C, FGATE_Y, and FGATE_K sequentially become active low in accordance with time intervals approximately corresponding to spacing intervals among the photosensitive drums 6*m*, 6*c*, 6*y*, and 6*k*. While each of the sub-scan image area signals is in the active low state, the optical write unit 8 emits the laser beam corresponding to the image color, and forms an electrostatic latent image on each of the photosensitive drums 6*m*, 6*c*, 6*y*, and 6*k*.

Then, for example, as illustrated in FIG. 4, if executing a positional displacement correction after printing of the Nth page is determined during a position adjustment operation, formation of a position adjustment pattern for each color is started at a time P when a predetermined time X has elapsed from a negation edge E of a sub-scan image area signal for each color. At this time, the position adjustment pattern for each color is formed on the spacing area S.

In this regard, assertion and negation timings of each of the sub-scan image area signals, FGATE_M, FGATE_C, FGATE_Y, and FGATE_K, are determined according to count information of a number of a horizontal synchronizing signal (not illustrated). Furthermore, the formation of the position adjustment pattern is started according to count information of a number of delay lines from the negation edge E of the sub-scan image area signal for each color. The counting of the number of the horizontal synchronizing signal and the number of delay lines are performed by the write control unit 8*a*.

Incidentally, the spacing area S in the sub-scan image area signals of respective colors, FGATE_M, FGATE_C, FGATE_Y, and FGATE_K, has a considerably short time length compared with the transfer sheet.

Thus, by using the negation edge E of the sub-scan image area signal as a reference point of the pattern formation, the position adjustment pattern can be formed at a constant timing, regardless of the size of the transfer sheet 1.

Furthermore, management of the position adjustment operation can be simplified, and the reliability of the image forming apparatus 100 may be increased. Moreover, the required bit number for the count information of delay lines may be reduced.

In addition to the position adjustment pattern as described above, for example, a process control pattern, a blade curl suppression pattern to suppress curling of a cleaning blade in the cleaner 15 of FIG. 1, and other patterns may be formed according to the pattern forming method.

All of the position adjustment pattern, the process control pattern, and the blade curl suppression pattern can be formed together on the spacing area S. In such an embodiment, all the patterns need to be properly formed so as to achieve full performance thereof.

Moreover, the position adjustment or the process control may be requested when image formation is not performed onto the transfer sheet 1, for example, when the image forming apparatus 100 is in a stand-by mode.

Also, in such a case, the control operation of the position adjustment pattern need to be executed. Therefore, another sub-scan image area signal is created for each color, so that each of the sub-scan image area signals, FGATE_M, FGATE_C, FGATE_Y, and FGATE_K forms two lines for an extremely short time. Then, another position adjustment pattern is formed based on a negation edge E of the second sub-scan image area signal.

Thus, the management method to control the position adjustment pattern does not need to be changed between when continuous printing is executed and when image formation onto transfer sheet 1 is not executed. Accordingly, the control operation of the position adjustment pattern can be simplified, and the reliability of the image forming apparatus 100 may be increased.

Figure 5:
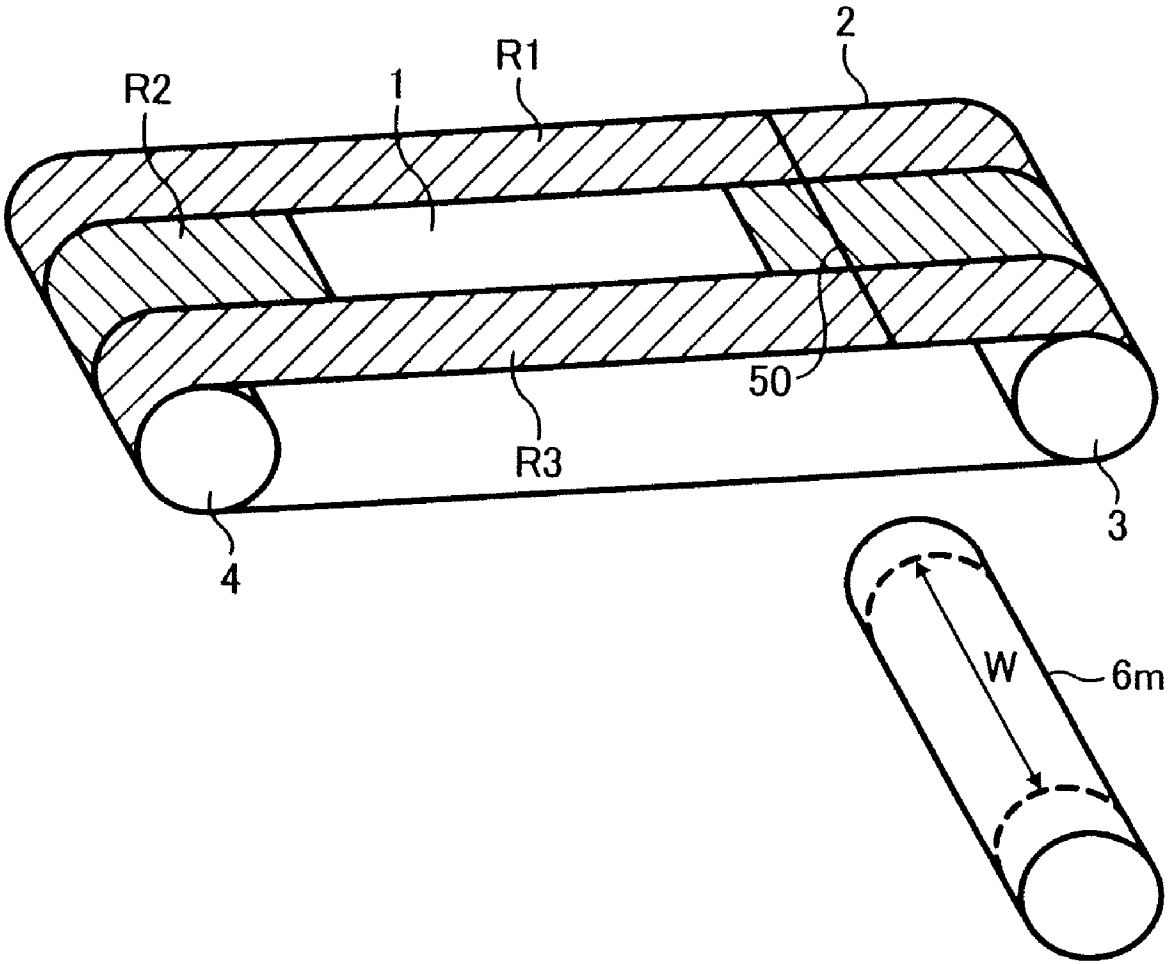
FIG. 5 is a schematic diagram of the conveyor belt and the photosensitive drum of FIG. 1.

Finally, referring to FIG. 5, the blade curl suppression pattern and a control operation to suppress curling of the cleaning blade are described.

FIG. 5 is a schematic diagram of the conveyor belt 2 and the photosensitive drum 6*m* of FIG. 1. The photosensitive drum 6*m* is separately illustrated below the conveyor belt 2 for clarity. The cleaning blade in the cleaner 15, not illustrated in FIG. 5, is arranged at the position opposed to the conveyance belt 2 as illustrated in FIG. 1.

In FIG. 5, R2 represents a sheet conveyance area, on which a transfer sheet may be attached to be conveyed, and R1 and R3 represent margin areas thereof.

A curl suppression toner pattern 50 is formed on the conveyor belt 2 and is supplied to the cleaning blade. Thereby, the curl suppression toner pattern 50 serves as a lubricant to suppress curling of the cleaning blade, which may be caused by a frictional force between the cleaning blade and the conveyor belt 2.

More specifically, the curl suppression toner pattern 50 is formed on the spacing area S (described above with reference to FIG. 4) of the conveyor belt 2, once a predetermined print volume has been reached. At this time, the curl suppression toner pattern 50 is formed based on a negation edge E of a sub-scan image area signal of each color, as described above.

Also, the curl suppression toner pattern 50 is formed so as to have a maximum width W of image area of the photosensitive drum 6*m*. However, when an electrostatic latent image on the photosensitive drum 6*m* is developed as a toner image with the developer 9*m*, excess toner may be attached to a non image area of the photosensitive drum 6*m*. Furthermore, as illustrated in FIG. 5, when the maximum width W of image area of the photosensitive drum 6*m* is larger than the width of a transfer sheet 1, the excess toner attached on the non image area of the photosensitive drum 6*m* is transferred onto the transfer sheet 1 and additionally onto the conveyor belt.

Consequently, a toner amount attached on the sheet conveyance area R2 is smaller than a toner amount attached on the margin area R1 or the margin area R3, approximated by the excess toner amount transferred onto the transfer sheet 1.

Therefore, to equalize the toner amount differences among the margin area R1, the sheet conveyance area R2, and the margin area R3, an image size of the curl suppression toner pattern 50 is changed for each area.

Specifically, the size of the transfer sheet 1 is detected with a sheet size detector (not illustrated). Then, an irradiation time of the laser beam for writing the curl suppression toner pattern 50 onto each of the margin areas R1 and R3 is changed according to signals from the CPU 45. Thereby, the image size of the curl suppression toner pattern 50 is controlled according to the area.

The image size of the curl suppression toner pattern 50 on the sheet conveyance area R2 may be increased to a level at which the blade curl can be suppressed, corresponding to the size of the transfer sheet 1. Alternatively, the image size of the curl suppression toner pattern 50 on the margin areas R1 and R3 may be decreased to a level at which a cleaning failure is not caused.

Thus, the toner amounts attached on the margin area R1, the sheet conveyance area R2, and the margin area R3 can be equalized, and thereby, the blade curl and the cleaning failure can be suppressed.

This invention may be conveniently implemented using a conventional general purpose digital computer programmed according to the teachings of the present specification, as will be apparent to those skilled in the computer art. Appropriate software coding can readily be prepared by skilled programmers based on the teachings of the present disclosure, as will be apparent to those skilled in the software art. The present invention may also be implemented by the preparation of application specific integrated circuits or by interconnecting an appropriate network of conventional component circuits, as will be readily apparent to those skilled in the art.

Numerous additional modifications and variations are possible in light of the above teachings. It is therefore to be understood that within the scope of the appended claims, the disclosure of this patent specification may be practiced otherwise than as specifically described herein.

What is claimed is:

1. A color image forming apparatus, comprising:

a conveying member having a surface configured to convey a plurality of transfer sheets, the surface including a spacing area between at least two adjacent transfer sheets on the surface of the conveying member;

a plurality of image carrying members that are arranged in tandem, configured to carry images and configured to transfer the images onto the transfer sheets conveyed by the conveying member;

a signal generator configured to generate a first timing signal for at least one of a plurality of colors formed by the color image forming apparatus, the first timing signal including a first sub-scan image area signal that indicates an effective image area in a sub-scanning direction of one of the plurality of transfer sheets, and configured to generate a second timing signal for at least one of the plurality of colors formed by the image forming apparatus, the second timing signal including a second sub-scan image area signal that is generated for a short period of time when the color image forming apparatus is in a stand-by mode such that image formation is not performed onto the transfer sheets;

a counter configured to count delay lines to determine whether a first predetermined time has elapsed from a first negation timing of the first sub-scan image area signal, the first negation timing occurring at a negation edge of the first sub-scan image area signal and the negation edge corresponds to a trailing edge of the one of the plurality of transfer sheets, and configured to count delay lines to determine whether a second predetermined time has elapsed from a second negation timing of the second sub-scan image area signal, the second negation timing occurring at a negation edge of the second sub-scan image area signal; and a pattern formation mechanism configured to form a first maintenance pattern on the spacing area after the first predetermined time has elapsed from the first negation timing of the sub-scan image area signal, and configured to form a second maintenance pattern, when the color image forming apparatus is in the stand-by mode such that image formation is not performed onto the transfer sheets, on the conveying member after the second predetermined time has elapsed from the second negation timing of the sub-scan image area signal.

2. The color image forming apparatus according to claim 1, wherein a timing signal is generated for each of the plurality of colors formed by the color image forming apparatus capable of indicating the spacing area in image forming.

3. The color image forming apparatus according to claim 1, wherein at least one of the first and second maintenance patterns is a process control pattern.

4. The color image forming apparatus according to claim 3, wherein the pattern formation mechanism is configured to form the first and second maintenance patterns independently of operation of at least one maintenance task that is unrelated to the maintenance pattern and separately from an image forming operation onto the transfer sheet.

5. The color image forming apparatus according to claim 1, wherein at least one of the first and second maintenance patterns is a position adjustment pattern.

6. The color image forming apparatus according to claim 1, wherein at least one of the first and second maintenance patterns is a blade curl suppression pattern.

7. A maintenance pattern forming method for use in a color image forming apparatus, comprising:

conveying a plurality of transfer sheets on a surface of a conveying member such that there is a spacing area on the surface of the conveying member between at least two adjacent transfer sheets;

generating a first timing signal for at least one of a plurality of colors formed by the color image forming apparatus;

forming a first maintenance pattern on the spacing area based on the first timing signal, wherein a first timing signal is generated for each of the plurality of colors formed by the color image forming apparatus capable of indicating the spacing area in image forming, the first maintenance pattern is at least one of a process control pattern, a position adjustment pattern, or a blade curl suppression pattern, the first timing signal for each of the plurality of colors includes a first sub-scan image area signal indicating an effective image area in a sub-scanning direction of one of the plurality of transfer sheets, the forming of at least one of the process control pattern, the position adjustment pattern, or the blade curl suppression pattern is started after a first predetermined time has elapsed from a first negation timing of the first sub-scan image area signal, wherein the first negation timing occurs at a negation edge of the first sub-scan image area signal on a trailing end of the one of the plurality of transfer sheets and the negation edge corresponds to a trailing edge of the one of the plurality of transfer sheets;

generating a second timing signal, when the color image forming apparatus is in a stand-by mode such that image formation is not performed onto the transfer sheets, for at least one of the plurality of colors formed by the color image forming apparatus;

forming a second maintenance pattern on the conveying member, when the color image forming apparatus is in the stand-by mode such that image formation is not performed onto the transfer sheets, based on the second timing signal, wherein a second timing signal is generated for each of the plurality of colors formed by the color image forming apparatus, the second maintenance pattern is at least one of a process control pattern, a position adjustment pattern, or a blade curl suppression pattern, the second timing signal for each of the plurality of colors includes a second sub-scan image area signal, the forming of at least one of the process control pattern, the position adjustment pattern, or the blade curl suppression pattern is started after a second predetermined time has elapsed from a second negation timing of the second sub-scan image area signal, wherein the second negation timing occurs at a negation edge of the second sub-scan image area signal; and providing a counter to count a number of lines in order to determine that the first or the second predetermined time has elapsed from the first or the second negation timing of the first or the second sub-scan image area signal.

8. The maintenance pattern forming method according claim 7, wherein the forming at least one of the first and second maintenance patterns is performed independently of operation of at least one maintenance task that is unrelated to the maintenance pattern and separately from an image forming operation onto the transfer sheets.

9. A color image forming apparatus, comprising:

a conveying member having a surface configured to convey a plurality of transfer sheets, the surface including a spacing area between at least two adjacent transfer sheets on the surface of the conveying member;

a plurality of image carrying members that are arranged in tandem, configured to carry images and configured to transfer the images onto the transfer sheets conveyed by the conveying member;

a signal generator configured to generate a first timing signal and a second timing signal for at least one of a plurality of colors formed by the color image forming apparatus; and a pattern formation mechanism configured to form a first maintenance pattern on the spacing area based on the timing signal, and configured to form, when the color image forming apparatus is in a stand-by mode such that image formation is not performed onto the transfer sheets, a second maintenance pattern on the conveying member based on the second timing signal, wherein a first timing signal is generated for each of the plurality of colors formed by the color image forming apparatus capable of indicating the spacing area in image forming, and a second timing signal is generated for each of the plurality of colors formed by the color image forming apparatus when the color image forming apparatus is in the stand-by mode, wherein at least one of the first and second maintenance patterns is at least one of a process control pattern, a position adjustment pattern, or a blade curl suppression pattern, wherein the first timing signal for each of the plurality of colors includes a first sub-scan image area signal indicating an effective image area in a sub-scanning direction of one of the plurality of transfer sheets, and the second timing signal for each of the plurality of colors includes a second sub-scan image area signal, wherein at least one of the process control pattern, the position adjustment pattern, or the blade curl suppression pattern is started to be formed after a first predetermined time has elapsed from a first negation timing of the first sub-scan image area signal, wherein the first negation timing occurs at a negation edge of the first sub-scan image area signal on a trailing end of the one of the plurality of transfer sheets and the negation edge corresponds to a trailing edge of the one of the plurality of transfer sheets, and at least one of the process control pattern, the position adjustment pattern, or the blade curl suppression pattern is started to be formed after a second predetermined time has elapsed from a second negation timing of the second sub-scan image area signal, wherein the second negation timing occurs at a negation edge of the second sub-scan image area signal when the color image forming apparatus is in the stand-by mode, and wherein a counter to count a number of lines is provided to determine that the first or second predetermined time has elapsed from the first or second negation timing of the first or second sub-scan image area signal.

* * * * *